US006363736B1

(12) United States Patent
Kunkel et al.

(10) Patent No.: US 6,363,736 B1
(45) Date of Patent: Apr. 2, 2002

(54) CONDENSATE EVAPORATOR PAN

(75) Inventors: Victoria C Kunkel, Sartell; Daniel K Wennerberg, Clear Lake; Joseph D Kunkel, Sartell, all of MN (US)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/813,680

(22) Filed: Mar. 21, 2001

(51) Int. Cl.[7] ..... F25D 21/14
(52) U.S. Cl. ..... 62/291; 248/247; 248/300
(58) Field of Search ..... 62/279, 285, 286, 62/291; 248/235, 247, 250, 300

(56) References Cited

U.S. PATENT DOCUMENTS

| | | | | |
|---|---|---|---|---|
| 2,355,289 A | | 8/1944 | Gibson | |
| 2,560,057 A | | 7/1951 | Williams | |
| 2,626,509 A | | 1/1953 | Morrison | |
| 4,156,352 A | | 5/1979 | Gelbard et al. | |
| 4,471,633 A | | 9/1984 | Tinsler | |
| 4,685,575 A | * | 8/1987 | Kulbersh | 248/235 |
| 4,783,971 A | | 11/1988 | Alba | |
| 4,843,835 A | | 7/1989 | Goetz et al. | |
| 5,117,523 A | | 6/1992 | Jacobus et al. | |
| 5,195,332 A | | 3/1993 | Sullivan | |
| 5,207,074 A | | 5/1993 | Cox et al. | |
| 5,226,286 A | | 7/1993 | Mo | |
| 5,351,842 A | * | 10/1994 | Remmers | 248/235 |
| D373,719 S | * | 9/1996 | Lin | 248/235 |
| 5,664,431 A | * | 9/1997 | Martin, Sr. | 62/286 |
| 5,694,785 A | * | 12/1997 | Balentine | 62/286 |
| 5,699,677 A | | 12/1997 | Hakala et al. | |

* cited by examiner

*Primary Examiner*—William E. Tapolcal
*Assistant Examiner*—Mohammad M. Ali
(74) *Attorney, Agent, or Firm*—Pearne & Gordon LLP

(57) ABSTRACT

A condensate collection structure for collecting and evaporating liquid condensation from a refrigerator or freezer in which a bracket assembly attached to the refrigeration housing unit supports both a condenser tubing array and a removable condensate drain pan. The condenser tubing array extends within and adjacent the bottom of the condensate drain pan when the drain pan is attached to the bracket assembly.

14 Claims, 3 Drawing Sheets

CONDENSATE EVAPORATOR PAN

FIELD OF INVENTION

The present invention relates to refrigeration devices that have a defrost cycle and more specifically to condensate collection structures for such devices.

BACKGROUND OF THE INVENTION

Refrigeration devices generally have a refrigeration loop including a compressor, a condenser, an expansion valve, and an evaporator. Typically, frost that is built up on the evaporator is melted by a self-defrosting feature and the condensate is collected in a condensate drain pan or similar container, so that heat or air flowing through the compartment will evaporate the condensate.

During a defrost cycle in a typical refrigerator or freezer unit, the evaporator is heated to melt the frost that has accumulated within the freezer. The condensate drains out of the freezer to a condensate drain pan located in the bottom portion of the refrigerator or freezer. The liquid condensate typically evaporates from the drain is pan before the next defrost cycle. A heat exchange coil disposed in or adjacent to the drain pan usually serves the purpose of evaporating the condensate and removing the superheat from the compressed refrigerant before it is discharged into the motor is compressor casing. The drain pan is typically mounted on the compressor housing in order to promote evaporation of condensate collected in the drain pan.

A number of prior art techniques have been proposed for evaporating collected condensate from the evaporator of a refrigeration device. An early example of such prior art techniques may be found in U.S. Pat. No. 2,626,509 wherein the patentee provides an array of condenser coils within an enclosed condensate pan which is permanently mounted within the lower compressor to return moist air to the refrigeration compartment through an attached conduit.

A further early example may be found in U.S. Pat. No. 2,355,289 wherein the patentee provides a refrigerator unit in the form of a self-contained air conditioning unit which has a condensate collection pan surrounding the hot coil of a compressor. Hot compressed gas flowing through the coil causes evaporation of the condensate and the condensate is picked up by air flowing over the compressor and the pan of condensate.

A later example of such a prior art technique may be found in U.S. Pat. No. 4,783,971 wherein the patentees disclose a refrigeration device which includes a condensate collection pan mounted over an array of condenser coils. During a defrost cycle, the compressor is deactivated and a heating coil proximate to the evaporator is activated. The resulting water is drained to the drip pan where a fan circulates air across the drain pan to cool the condenser coil and evaporate the water in the pan.

BRIEF SUMMARY OF THE INVENTION

This invention provides an improved condensate drain pan structure where the condensate will be quickly evaporated and where the drain pan itself is removable for cleaning. According to the present invention, a condensate collection structure includes a mounted bracket assembly that supports both a condenser tubing array and a removable condensate drain pan.

The bracket assembly is fixed to the bottom cabinet of a refrigerator or freezer unit by being cantilevered from a vertical wall thereof and supports a length of condenser tubing. The tubing may be wound in a serpentine manner to form a planar rectangular horizontal array. When a condensate drain pan is attached to the bracket assembly, the condenser tubing array fits down into and extends adjacent to the bottom of the drain pan. The condensate drain pan collects the condensate from the evaporator as it is heated during a defrost cycle. The liquid condensate collected in the condensate drain pan is evaporated out of the pan as it is heated by the condenser tubing during a refrigerator cycle. The condensate drain pan can be removed for cleaning by detaching the drain pan from the bracket assembly and then sliding the drain pan from underneath the condenser tubing array. The cantilevered mounting arrangement for the condenser tubing and the condensate pan eliminates complex mounting arrangements present in the prior art which increase assembly and repair costs.

DETAILED DESCRIPTION OF THE INVENTION

Figure 1:
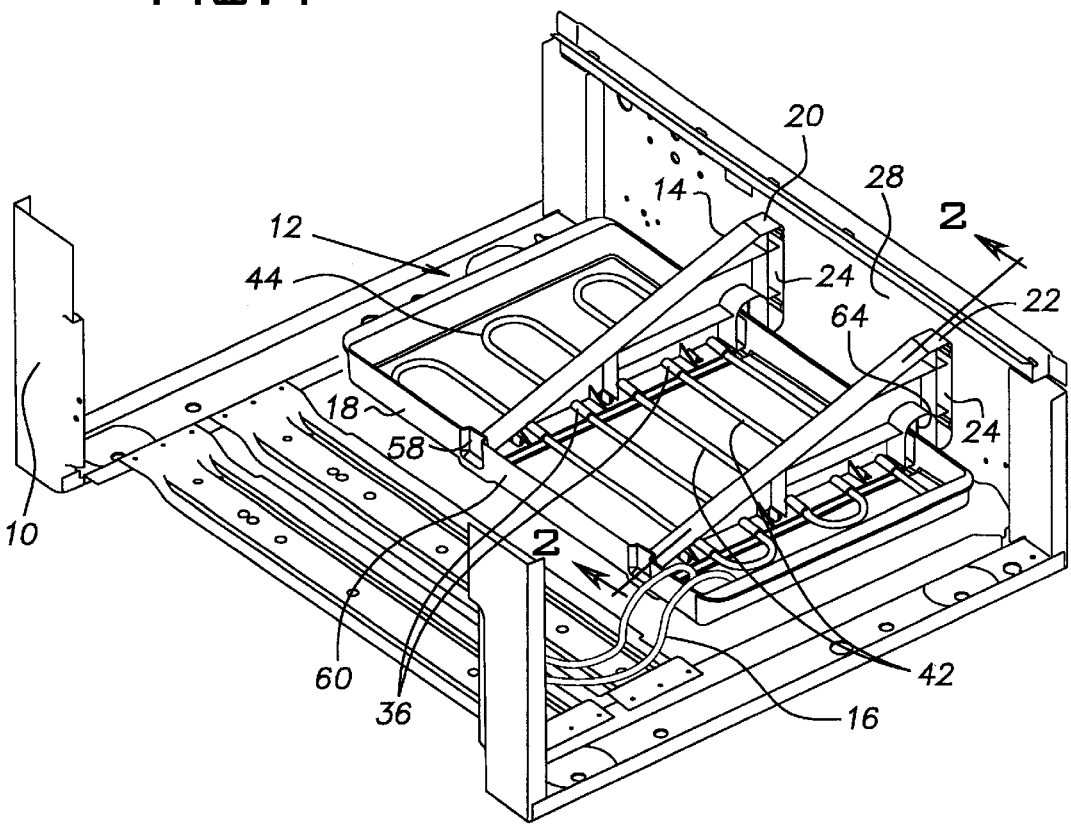
FIG. 1 is a front perspective view of the bottom cabinet of a refrigerator incorporating an embodiment of the present invention.
Figure 2:
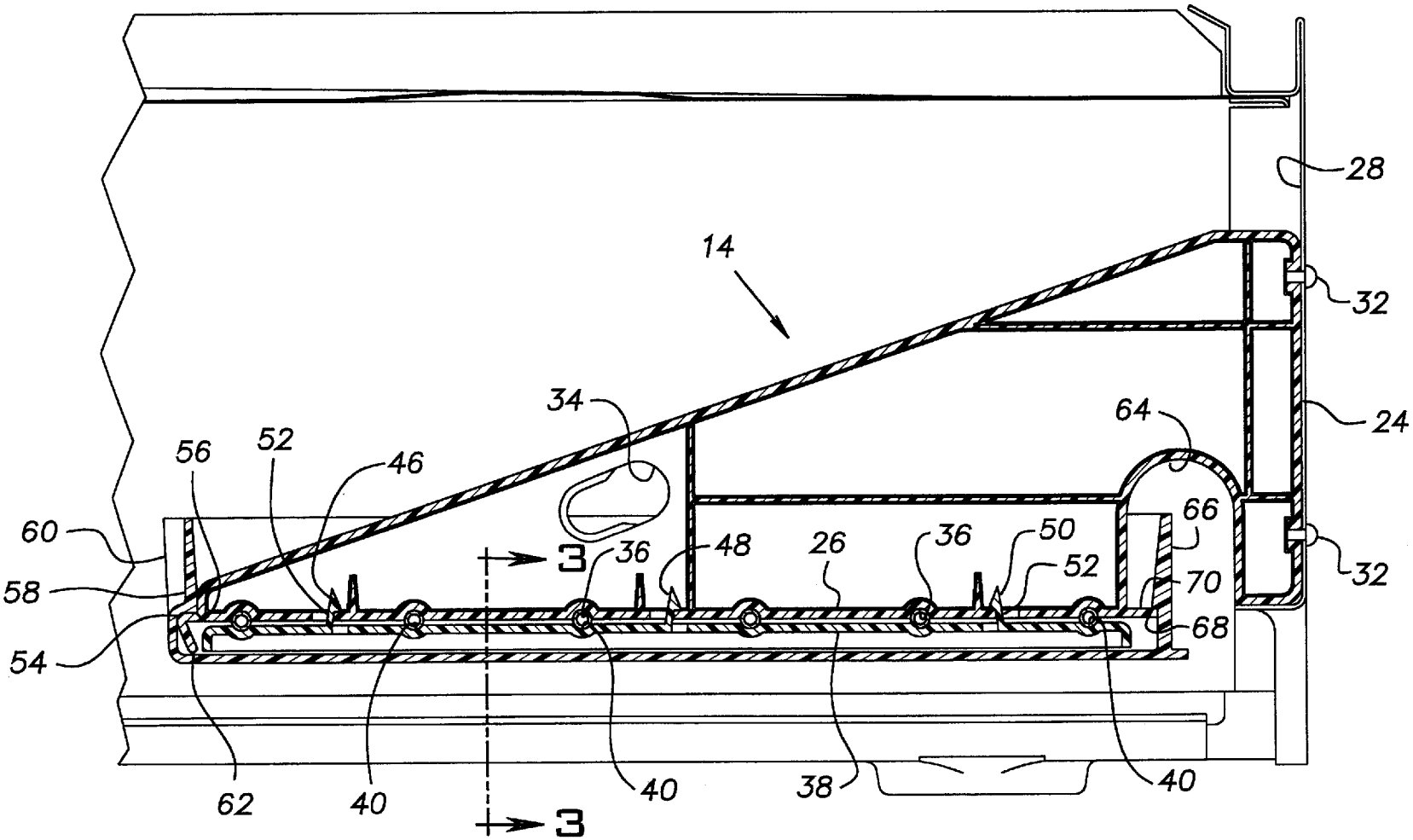
FIG. 2 is a side cross-sectional view of the invention, the plane of the section being indicated by the line 2—2 in FIG. 1.

Referring now to the drawings, FIGS. 1–2 show a condensate collection structure housed in a bottom cabinet 10 of a refrigerator or refrigeration device having a defrost cycle. The condensate collection structure 12 includes a bracket assembly 14, condenser tubing 16, and a removable condensate drain pan 18. The bracket assembly 14 supports both the condenser tubing 16 and the removable condensate drain pan 18. The condenser tubing 16 is connected to a compressor (not shown) provided in the rear of the bottom cabinet 10.

The bracket assembly 14 has two elongated triangular brackets 20 and 22, each with a vertical leg 24 and a horizontal leg 26. The vertical leg 24 is fixed to a vertical wall 28 in the cabinet 10 of the refrigerator by mounting screws 32, so that the brackets 20 and 22 are cantilevered into the cabinet 10. The vertical leg 24 is provided with a drain hose insertion hole 34 to hold a drain hose (not shown), which drains the liquid condensate from the evaporator (not shown) into the condensate drip pan 18.

The condenser tubing 16 is supported and located in semicylindrical transverse grooves 36 formed by the horizontal leg 26. A cap strip 38 is provided on each horizontal leg 26 and is provided with semi-cylindrical transverse grooves 40 which cooperate with the grooves 36 to retain the condenser tubing 16 therebetween, as will be apparent. The condenser tubing 16 is wound in a serpentine manner to provide a number of parallel reaches 42 and to form a flat rectangular condenser tubing array 44 that fits into and extends adjacent or closely adjacent to the bottom of the condensate drain pan 18. The condenser tubing may also be formed in other tubing array shapes depending on the size and shape of the condensate drain pan and refrigerator housing. The cap strip 38 is provided with connecting barbs 46, 48 and 50 which snap into corresponding slots 52 in the leg to sandwich the reaches 42 in the grooves 36 and 40 to thereby support the tubing array 44. It should be noted that at least one of the barbs, for example, the barb 50, is reversed to face its neighboring barb 48 to securely grip the horizontal leg 26. The barbs 46, 28, and 50 are sufficiently flexible to perform this function since the bracket assembly is made from a suitable plastic such as fiber-reinforced polypropylene.

Figure 4:
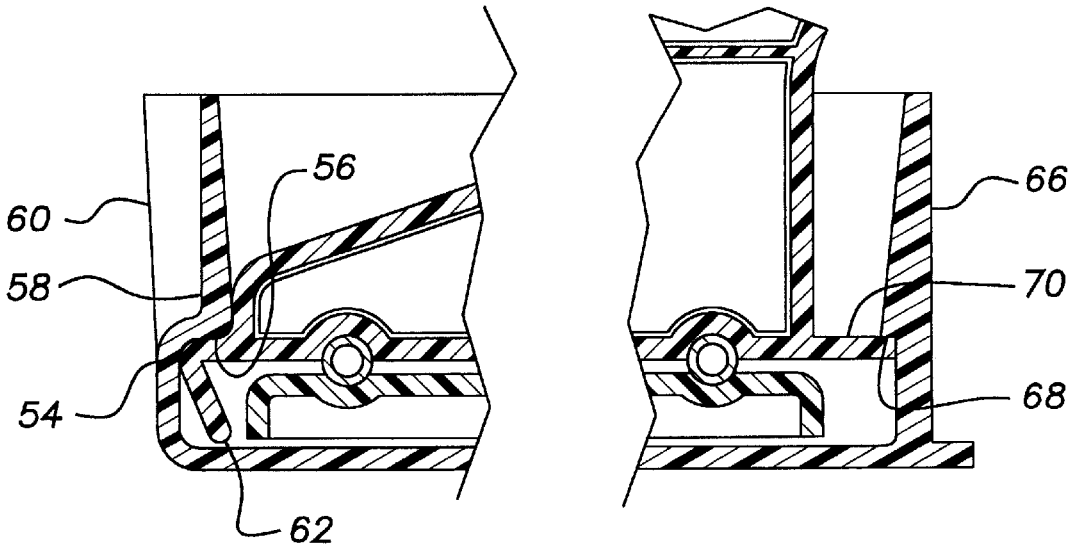
FIG. 4 is an enlarged view of the drain pan connection to the bracket assembly.

The condensate drain pan 18 may also be made from polypropylene and is removably attached to the horizontal leg 26. The condensate drain pan 18 collects the liquid condensate from the evaporator in the refrigerator as it is heated during a defrost cycle and drains into the drain hose. The liquid condensate collected in the drain pan is evaporated out of the pan as it is heated by the condenser tubing array 44. The vaporized condensate is vented to the atmosphere or ambient space. The drain pan 18 is removably attached to the brackets 20 and 22 in a manner which may be seen most clearly in FIG. 4. At the distal end of each bracket 20 and 22 there is provided a nose portion 54 which snaps into a detent 56 formed by indented portion 58 in a wall 60 of the pan 18. It may be noted that this operation is facilitated by the fact that the vertical wall of the indented portions 58 is provided with a slight taper and that the nose portion 54 has an inwardly inclined end portion 62 which is cammed along the taper until the nose portion 54 snaps in place. This operation is conducted in a facile manner since the pan is plastic and, in the illustrated embodiment, has a nominal wall thickness of about 0.10 inch. The proximal end of the brackets 20 and 22 are provided with an arched recess 64 which is adapted to receive an opposite wall 66 of the pan 18. The wall 66 has an interior taper forming a barb 68 which snaps over an inwardly projecting portion of 70 of the arched recess 64.

Figure 3:
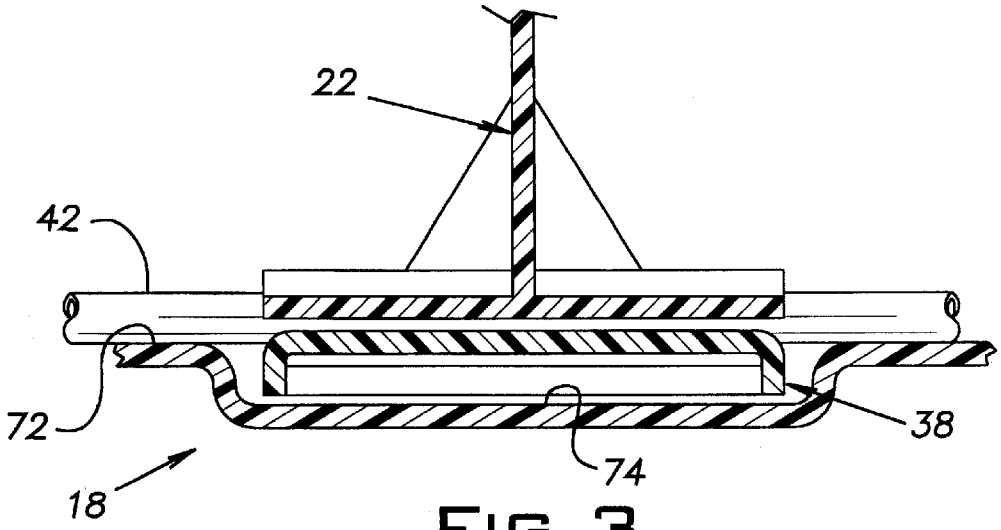
FIG. 3 is an enlarged cross-sectional view, the plane of the section being indicated by the line 3—3 in FIG. 2.

Referring now to FIG. 3, a bottom 72 of the pan 18 is provided with a recess 74 for each cap strip 38. The recess 74 permits the reaches 42 of the tubing array 44 to lie adjacent or closely adjacent to the bottom 72 of the pan 18 to more effectively accomplish the evaporation of the water in the drip pan 18.

While the invention has been described with reference to a specific embodiment, various changes may be made and equivalents may be substituted for elements thereof by those skilled in the art without departing from the scope of the invention. In addition, other modifications may be made to adapt a particular situation or material to the teachings of the invention without departing from the essential scope thereof. The present invention herein is not to be construed as being limited, except insofar as indicated in the appended claims.

What is claimed is:

1. An apparatus for collecting and evaporating liquid condensation from a refrigerator or freezer comprising:

a housing unit;

a bracket assembly attached to the housing unit;

a condensate drain pan removably attached to the bracket assembly; and condenser tubing supported by the bracket assembly, said condenser tubing extending within and adjacent a bottom of the condensate drain pan when the drain pan is attached to the bracket assembly.

2. An apparatus as in claim 1 wherein the condenser tubing is wound in a serpentine manner to form a flat condenser tubing array.

3. An apparatus as in claim 1 wherein the bracket assembly contains at least one bracket having a first leg attached to the housing unit and a second leg supporting the condenser tubing as a cantilever.

4. An apparatus as in claim 3 wherein the condensate drain pan is removably attached to the second leg.

5. An apparatus as in claim 3 wherein a cap strip is fixed to said second leg and said condenser tubing is sandwiched between said second leg and said cap strip.

6. An apparatus according to claim 3 wherein said cap strip is provided with barbs that snap into slots in said second leg.

7. An apparatus according to claim 6 wherein said second leg and said cap strip are provided with opposed transverse grooves which sandwich parallel reaches of said condenser tubing array.

8. An apparatus according to claim 4 wherein said condensate drip pan includes at least one recess in said bottom, said cap strip being received in said recess so that said tubing array lies closely adjacent to said bottom.

9. An apparatus according to claim 4 wherein a distal end of each bracket is provided with a nose portion which snaps into a detent formed by indented portions in a wall of the pan, a vertical wall of said indented portions being provided with a slight taper, said nose portion having an inwardly inclined end portion which is cammed along the taper until the nose portion snaps in place to install said pan.

10. An apparatus according to claim 9 wherein a proximal end of each bracket is provided with an arched recess which is adapted to receive an opposite wall of the pan, said opposite wall having an interior taper forming a barb which snaps over an inwardly projecting portion of said recess.

11. An apparatus for collecting and evaporating liquid condensation from a refrigerator or freezer comprising:

a housing unit;

a bracket assembly comprising a pair of brackets having a first leg and a second leg, said first leg being fixed to a vertical wall of said second leg by projecting horizontally from said vertical wall as a cantilever;

a condensation drain pan being removably attached to said second leg; and an array of condensate tubing having parallel reaches within said pan and extending adjacent a bottom of said pan.

12. An apparatus as in claim 11 wherein the condensate drain pan is removably attached to the second leg.

13. An apparatus according to claim 11 wherein a distal end of each bracket is provided with a nose portion which snaps into a detent formed by indented portions in a wall of the pan, a vertical wall of said indented portions being provided with a slight taper, said nose portion having an inwardly inclined end portion which is cammed along the taper until the nose portion snaps in place to install said pan.

14. An apparatus according to claim 13 wherein a proximal end of each bracket is provided with an arched recess which is adapted to receive an opposite wall of the pan, said opposite wall having an interior taper forming a barb which snaps over an inwardly projecting portion of said recess.

* * * * *